United States Patent [19]

Palm et al.

[11] Patent Number: 4,708,596

[45] Date of Patent: Nov. 24, 1987

[54] DEVICE FOR REGULATING PRESSURE AND DELIVERY OF AND ADJUSTABLE PUMP

[75] Inventors: Volker Palm, Nussdorf; Berthold Pfuhl, Markgröningen, both of Fed. Rep. of Germany

[73] Assignee: Robert Bosch GmbH, Stuttgart, Fed. Rep. of Germany

[21] Appl. No.: 892,874

[22] Filed: Jul. 28, 1986

Related U.S. Application Data

[63] Continuation of Ser. No. 735,553, May 17, 1985, abandoned.

[30] Foreign Application Priority Data

Jun. 14, 1984 [DE] Fed. Rep. of Germany ..... 3422089

[51] Int. Cl.[4] ..... F04B 49/00

[52] U.S. Cl. ..... 417/218; 417/222; 60/450; 60/459

[58] Field of Search ..... 417/212, 213, 218–222; 60/450, 452, 459

[56] References Cited

U.S. PATENT DOCUMENTS

| | | | |
|---|---|---|---|
| 3,777,492 | 12/1973 | Boydell et al. | 417/218 X |
| 3,996,744 | 12/1976 | Ridge | 417/212 X |
| 4,158,529 | 6/1979 | Nonnemacher et al. | 417/218 X |
| 4,325,677 | 4/1982 | Nonnemacher et al. | 417/218 |

FOREIGN PATENT DOCUMENTS

| | | | |
|---|---|---|---|
| 44518 | 1/1982 | European Pat. Off. | 417/218 |
| 2904474 | 8/1980 | Fed. Rep. of Germany | 417/218 |
| 3016609 | 11/1981 | Fed. Rep. of Germany | 417/220 |
| 3143074 | 5/1983 | Fed. Rep. of Germany | 417/213 |
| 222989 | 12/1983 | Japan | 417/218 |
| 2067791 | 7/1981 | United Kingdom | 417/218 |

*Primary Examiner*—William L. Freeh
*Assistant Examiner*—Paul F. Neils
*Attorney, Agent, or Firm*—Michael J. Striker

[57] ABSTRACT

A pressure and delivery regulating device for an adjustable pump includes a directional control valve connected in a discharge conduit and to a control conduit branching from the discharge conduit between the pump and the directional control valve. The control conduit leads to a setting piston for the adjustment of the pump. The directional control valve is controlled by a solenoid which in turn is controlled by a control system consisting of a regulating circuit, a delivery limiting circuit and a control circuit for the solenoid. The output signal from the regulating circuit controls a desired delivery value signal supplied to the delivery limiting circuit. A follow-up circuit connected between the regulating circuit and the delivery limiting circuit corrects the regulating signal and a circuit for producing a direction dependent signal from the actual pressure provides a damping of the regulating circuit.

5 Claims, 1 Drawing Figure

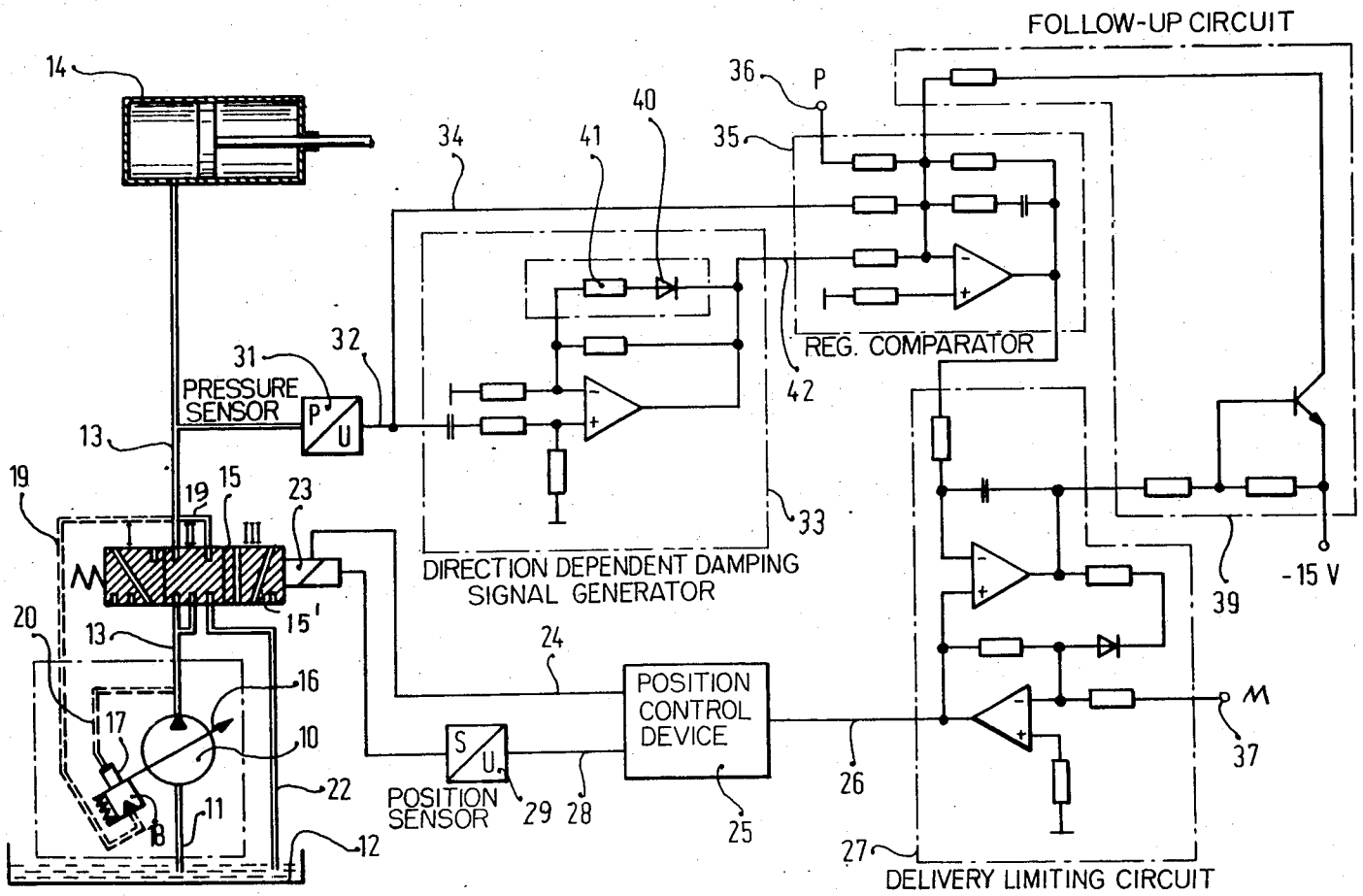
FOLLOW-UP CIRCUIT
-15 V
39
37
M
DELIVERY LIMITING CIRCUIT
REG. COMPARATOR
P
36
35
42
33
26
27
40
41
34
DIRECTION DEPENDENT DAMPING SIGNAL GENERATOR
POSITION CONTROL DEVICE
25
24
28
29
POSITION SENSOR
32
31
PRESSURE SENSOR
23
15'
15
19
16
10
22
12
11
13
17
20
14

DEVICE FOR REGULATING PRESSURE AND DELIVERY OF AND ADJUSTABLE PUMP

This application is a continuation of application Ser. No. 735,553, filed May 17, 1985, now abandoned.

BACKGROUND OF THE INVENTION

This invention relates in general to a device for regulating pressure and delivery of an adjustable pump having a setting member which is adjustable by means of a pressure actuated piston which in turn is controlled by a directional control valve.

In prior-art devices of this type it is necessary to use corresponding actual value sensors for the regulation of the pressure and flow delivery. The regulators must have been switched over or designed as limiting circuits with an automatic transition from the flow rate to pressure regulation. When a regulation device is used for controlling a pump in an injection die casting machine then it encounters the problem that during the phases of velocity deregulation of the pressure cylinder the pressure regulator runs at a setting limit and consequently an optimum transition from velocity regulation to pressure regulation is not possible.

SUMMARY OF THE INVENTION

It is, therefore, a general object of this invention to overcome the disadvantage.

More particularly, it is an object of this invention to provide a device for adjusting the delivery or the pressure in an adjustable pump to a predetermined desired value in such a manner that the transition from the delivery to pressure regulation is improved.

Another object of this invention is to provide such an improved regulating device which guarantees a proper damping and transient behavior.

In keeping with these objects and others which will become apparent hereafter, one feature of the invention resides in a regulating device of the before-described type, in a combination which comprises an electrically controlled directional control valve connected between a discharge conduit and a return conduit of the pump, the pressure actuated piston communicating with the discharge conduit downstream of the directional control valve, means for sensing actual pressure in the discharge conduit, means for comparing the sensed pressure value with a desired pressure value to produce a regulating signal indicative of a desired quantity of delivery, means for sensing position of the directional control valve, means for controlling the position of the directional position controlling valve, the control means having an input connected to the position sensing means and an output connected to an electrical drive of the directional control valve, and means for limiting a quantity of the delivery of the pump, the limiting means having an input supplied with a regulating signal and an output connected to another input of the position controlling sleeve means.

In the preferred embodiment of this invention there is provided a circuit for producing a derived value of the actual pressure which in cooperation with a follow-up circuit connected between the limiting means and the comparing means applies a correction signal to the comparing means so as to insure an improved damping and transition behavior of the regulating device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates a circuit diagram of a device for regulating pressure and delivery of an adjustable pump.

DESCRIPTION OF THE PREFERRED EMBODIMENT

In the FIGURE, reference numeral 10 designates an adjustable pump which sucks via a suction conduit 11 a pressure medium from a tank 12 and displaces the medium through a delivery or discharge conduit 13. The discharge conduit leads to a consumer in the form of a hydraulic cylinder 14. A directional control valve 15 is connected in the discharge conduit 13 and is controlled by an electromagnetically operated drive such as the solenoid 23 for example, to continuously move between three switching positions, as it will be explained below.

The delivery of the pump is adjusted by a setting member 16 such as for example a tilting plate in an axial piston pump. The adjustment of the control of the setting member 16 of the pump is made by means of two mutually counteracting setting pistons 17 and 18 having different piston areas. The setting piston 18 is acted upon by a stream of pressure fluid supplied via control conduit 19 from branched part 13' of the discharge conduit 13 which is located upstream of the direction control valve 15. The other setting piston 17 is acted upon via conduit 20 branched from the part of a discharge conduit 13 which is also located upstream of the directional control valve 15, namely between the valve and the outlet of the pump 10. In the illustrated switching position II of the valve 15, all parts of the latter are closed. In the switching position I, the upstream part of the discharge conduit 13 is closed and the working cylinder 14 is connected via a return conduit 22 to the tank. In the switching position III, the working cylinder 14 is connected via discharge conduit 13 to the outlet of the pump and simultaneously a connection is established via the branched part 13' of the discharge conduit, the valve 15 and the conduit 19 with the large area setting piston 18. The small area setting piston 17 is always connected to the outlet of the pump in any position of the directional control valve.

The directional control valve 15, as mentioned before, is continuously controlled by the solenoid 23 which is electrically connected via conductor 24 to an electromagnetic control device 25 whose input is connected via conductor 26 to the output of an electronic delivery limiting circuit 27. The directional control valve 15 is provided with a regulating passage 15' which in response to a control signal applied to solenoid 23 continuously regulates the flow of pressure medium from the branch conduit 13' into the control conduct 19 leading to the setting piston 18. A second input of the control device 25 is connected by a conductor 28 to the output of a position sensor 29 which detects the switching position of the valve 15. The position sensor 29 continuously supplies the control device 25 with a position signal which is processed in the control device 25 in dependency on a control signal received from the conductor 26 to produce a position controlling output signal M which is delivered via conductor 24 to the solenoid 23.

An actual pressure sensor 31 is coupled to the discharge conduit 13 between the working cylinder 14 and the valve 15 to convert the actual pressure into a corresponding electrical signal which is applied via a conductor 32 to a circuit 33 for producing a damping signal dependent on direction of the actual pressure a branching conductor 34 supplies the actual pressure signal to the input of a regulating comparator or amplifier 35 which receives via another input 36 a desired pressure value P at which the pump 10 is to be operated. A delivery limiting circuit 27 has an input 37 receiving a signal corresponding to a desired magnitude of delivery of the pump. This signal limits the maximum amount of delivery. A follow-up circuit 39 is connected between the regulating amplifier 35 and another input of the delivery limiting circuit 27. The electrical connection and operation of these functional blocks need not be discussed in detail because only their function is essential for making and using this invention. Only the series connection of the resistor 41 with diode 40 in the feedback path of the operational amplifier in the damping signal generating circuit 33 will be explained in greater detail below.

The working cylinder 14 is also illustrated only schematically and in this example represents a pressure cylinder of an injection molding machine. In this field of application, the course of velocity and pressure of the medium in the working cylinder 14 are of importance. The course of velocity affects the motion of the piston of the working cylinder. It is the direction control valve 15 which adjusts the flow delivery and the feed pressure of the pump according to the aforementioned desired values M and P. As long as the delivery limiting circuit 27 is inactive, the desired delivery signal M at the input 37 causes an invariable delivery of the pump corresponding to the signal M. The electronic control circuit 25 adjusts its output signal in conductor 24 in dependency on the desired delivery sginal M and sets a position of the directional control valve corresponding to a a value of the signal M. In the position of the valve 15 in which the setting piston 18 is connected via control conduit 19 with the branch 13' of the discharge conduit 13 before the valve 15, due to larger effective area of the piston 18 the applied force overbalances the force of the smaller setting piston 17 and the pump 10 is adjusted for an increased amount of delivery. The setting piston 18 in cooperation with the control circuit 25 thus maintain a constant pressure difference on setting member 16 of the delivery consequently the pump is adjusted to a valve which is proportional to the desired signal M.

The regulating amplifier 35 compares the actual pressure signal from the output of sensor 31 with the desired pressure signal P and the resulting difference signal after amplification is applied to the delivery limiting circuit 27 and limits the value of the desired delivery signal M so long until the signal at the output of pressure sensor 31 corresponds to the desired pressure value P at the input 36.

In other words, the regulating difference signal reduces the value of the control signal in conduit 26 at the output of delivery limiting circuit 27. The reduced control signal causes the control device 25 to adjust the directional control valve 15 into a position of reduced delivery. As a consequence, pressure in the part of discharge conduit 13 downstream of the valve 15 drops in proportion to the reduced flow and this process continues until the regulating difference signal at the output of regulating amplifier 35 is equal to or less than zero.

In order to achieve the regulation of delivery even at small differences between the desired and actual pressure values it is necessary that regulating amplifier 35 operates at a high static amplification factor. Inasmuch as this high static amplification is not possible with purely proportional amplification, the amplifier 35 is designed with an integrating amplification behavior. As a consequence, the regulating amplifier during a difference between the desired and actual values tends to operate at a setting limit. The follow-up circuit 39 insures that the correcting variable does not exceed the desired value of the desired delivery signal M and accordingly when the balance between the desired and actual pressure is reached, the regulating amplifier is prevented from immediately reducing the preset delivery signal M.

By means of the circuit 33 producing at its output a derivative signal from the course of the actual pressure the regulating amplifier 35 is damped and consequently an improved transitional behavior of the pressure is achieved. The series connection of the resistor 41 and of the diode 40 in the feedback path of the operational amplifier in the circuit 33 makes the damping of the regulator 35 dependent on the direction of the course of pressure signal; in this manner the behavior of the regulating path can be adjusted for an optimum transition from a delivery to pressure regulation and considerable improvement in comparison with conventional devices of this kind is achieved.

Instead of two setting pistons 17 and 18 it is also possible to provide a single setting piston counteracted by a spring force.

It will be understood that each of the elements described above, or two or more together, may also find a useful application in other types of constructions differing from the types described above.

While the invention has been illustrated and described as embodied in a specific example of a regulating device in connection with an axial piston pump, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

What is claimed is:

1. A device for regulating pressure and delivery of an adjustable pump connected via a discharge conduit to a consumer and having a setting member which is adjustable by means of a setting piston, comprising an electrically operated multi-position directional control valve connected to said discharge conduit to continuously control in a working position thereof the flow of a pressure medium delivered by said pump; said directional control valve including a regulating passage; a control conduit leading to said setting piston and being connected via said regulating passage to a branch of said discharge conduit upstream of said directional control valve; means for sensing actual pressure in said discharge conduit downstream of said directional control valve; means for comparing the sensed actual pressure value with a desired pressure value to produce a regulating difference signal; means for sensing actual position of the directional control valve; means for continuously controlling the actual working position of said directional control valve according to a control signal corresponding to a desired delivery value; and means for limiting said control singal in response to said regulating difference signal.

2. A device as defined in claim 1, wherein said means for sensing actual pressure is an electrohydraulic converter connected to said discharge conduit to produce an electrical signal corresponding to the sensed actual pressure.

3. A device for regulating pressure and delivery of an adjustable pump connected via a discharge conduit to a consumer and having a setting member which is adjustable by means of a setting piston, comprising an electrically operated multi-position directional control valve connected to said discharge conduit to continuously control in a working position thereof the flow of a pressure medium delivered b said pump; said directional control valve including a regulating passage; a control conduit leading to said setting piston and being connected via said regulating passage to a branch of said discharge conduit upstream of said directional control valve; means for sensing actual pressure in said discharge conduit downstream of said directional control valve; means for comparing the sensed actual pressure value with a desired pressure value to produce a regulating difference signal; means for sensing actual position of the directional control value; means for continuously controlling the actual working position according to a control signal corresponding to a desired delivery value; means for limiting said control signal in response to said regulating difference signal; and said means for sensing the actual position of said directional control valve being a motion pick-up coupled to said directional control valve for producing an electrical signal corresponding to the position of said valve.

4. A device for regulating pressure and delivery of an adjustable pump connected via a discharge conduit to a consumer and having a setting member which is adjustable by means of a setting piston, comprising an electrically operated multi-position directional control valve connected to said discharge conduit to continuously control in a working position thereof the flow of a pressure medium delivered by said pump; said directional control valve including a regulating passage; a control conduit leading to said setting piston and being connected via said regulating passage to a branch of said discharge conduit upstream of said directional control valve; means for sensing actual pressure in said discharge conduit downstream of said directional control value; means for comparing the sensed actual pressure value with a desired pressure value to produce a regulating difference signal; means for sensing actual position of the directional control value; means for continuously controllng the actual working position according to a control signal corresponding to a desired delivery value; means for limiting said control signal in response to said regulating difference signal; said means for controlling the actual working position having an input connected to an output of said limiting means, and an output connected to an electrical drive of said directional control valve; and said limiting means including a first input for receiving a desired delivery signal and a second input for receiving said regulating difference signal.

5. A device as defined in claim 4 further comprising means for producing from the sensed actual pressure a direction dependent damping signal, said damping signal being applied to said comparing means to damp said regulating difference signal during transition from a delivery-to pressure regulation.

* * * * *